United States Patent [19]

Rydstrom

[11] Patent Number: 4,773,204

[45] Date of Patent: Sep. 27, 1988

[54] CAP APPLYING APPARATUS

[75] Inventor: Gunnar Rydstrom, Molndal, Sweden

[73] Assignee: Wicanders Kapsyl AB, Alvangen, Sweden

[21] Appl. No.: 102,138

[22] Filed: Sep. 29, 1987

[30] Foreign Application Priority Data

May 26, 1987 [SE] Sweden ..... 8702204

[51] Int. Cl.[4] ..... B67B 3/26; B65B 7/28

[52] U.S. Cl. ..... 53/506; 53/72; 53/313

[58] Field of Search ..... 53/506, 505, 316, 315, 53/314, 313, 72, 64, 67, 75, 53, 282, 281, 485, 168

[56] References Cited

U.S. PATENT DOCUMENTS

| | | | |
|---|---|---|---|
| 2,734,674 | 2/1956 | Ray | 53/67 X |
| 2,897,643 | 8/1959 | Byrd | 53/506 |
| 3,350,842 | 11/1967 | Renish | 53/53 X |
| 3,460,314 | 8/1969 | Keas | 53/72 |
| 3,477,197 | 11/1969 | Budz | 53/53 |
| 4,312,172 | 1/1982 | Fisher et al. | 53/506 X |
| 4,498,275 | 2/1985 | Baron | 53/72 X |

*Primary Examiner*—James F. Coan

*Attorney, Agent, or Firm*—Brumbaugh, Graves, Donohue & Raymond

[57] ABSTRACT

An apparatus for applying caps on containers in which a primary cap-applicator applies the majority of caps and a secondary cap-applicator applies caps to the containers which have passed the primary cap-applicator without having been provided with a cap. A sensing means is arranged downstream of the primary cap-applicator to detect containers without caps and activate the secondary cap-applicator. This sensing means includes a photocell to detect a container and an inductive transducer to detect the cap on the container.

11 Claims, 1 Drawing Sheet

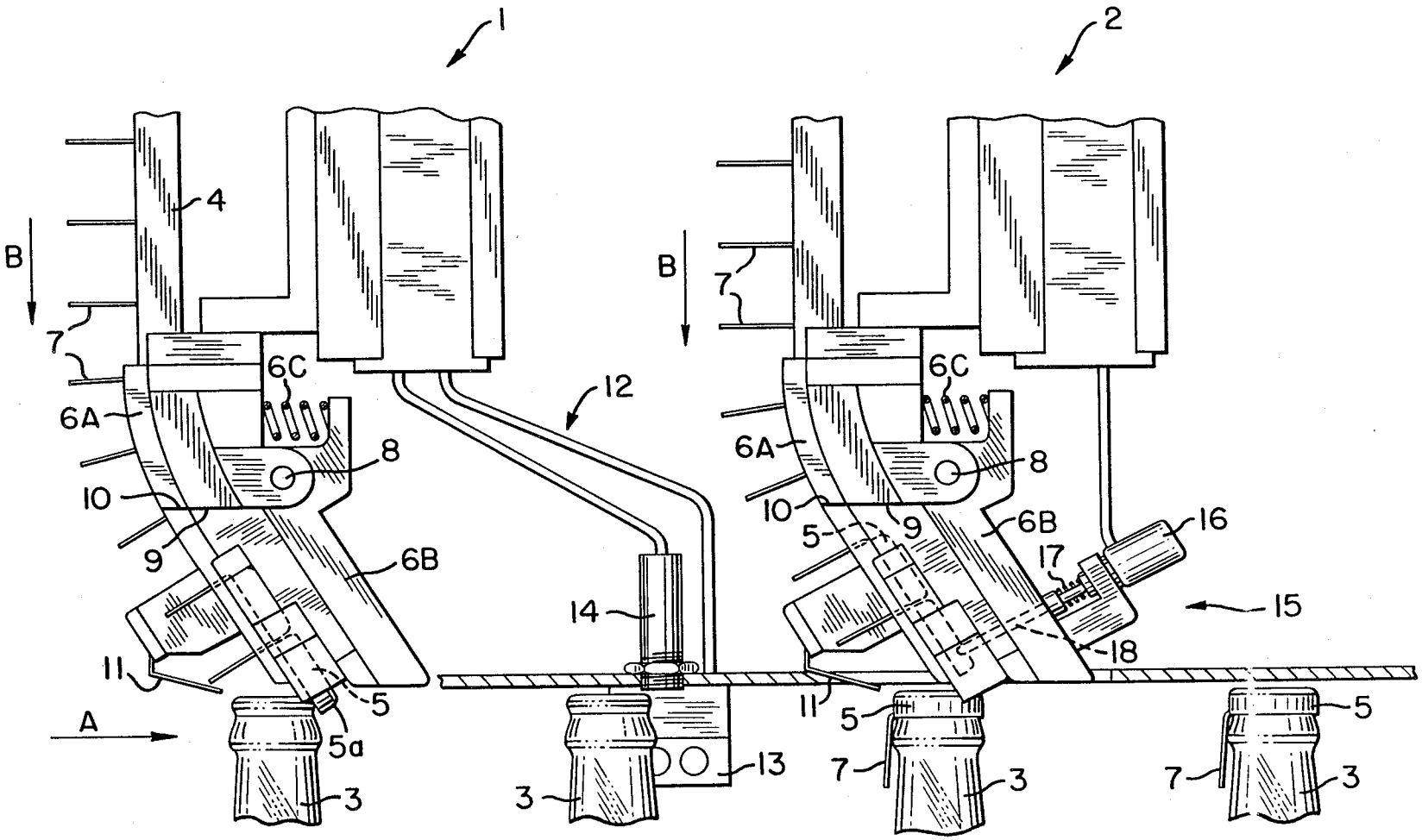
1
2
3
4
5
5a
6A
6B
6C
7
8
9
10
11
12
13
14
15
16
17
18
A
B

CAP APPLYING APPARATUS

BACKGROUND OF THE INVENTION

The present invention relates to an apparatus for applying caps on containers, and more particularly, to an apparatus of that type in which a cap is applied to the container by a secondary cap-applicator in the event that a cap was not applied by a primary cap-applicator.

In the sealing of bottles, a cap is applied to the mouth of the bottle immediately prior to its entry into a sealing head where the cap is sealed, generally by clamping or screwing. However, from time to time a bottle passes the capping station without a cap having been applied and must, therefore, be rejected when it leaves the machine. When the production rate is high, which is desirable from a productivity aspect, the risk of caps being missed, thus causing rejection losses, may be considerable and, therefore, the rate must be decreased to below that permitted by the other parts of the production apparatus. The cap-application capacity thus determines the production capability of the entire plane.

SUMMARY OF THE INVENTION

The object of the present invention is to provide an apparatus for achieving a higher capacity and lower rejection proportion than is possible with existing cap-application apparatus.

The object is achieved by providing a secondary cap-applicator in the production line following the primary cap-applicator for applying caps on containers which have passed the primary cap-applicator without having been provided with caps, and a sensing means located between the primary and secondary cap-applicators to detect containers without caps and thus render operative the secondary cap-applicator to apply a cap.

THE DRAWINGS

The drawing shows a side elevation of the cap applying apparatus embodying the invention.

DESCRIPTION OF PREFERRED EMBODIMENTS

Filled, unsealed bottles 3 are supplied to the cap-applicator apparatus shown in the drawying by a conveyor, not shown in detail, moving in the direction of the arrow A. Caps 5 are applied on the mouth of the bottle 3 in a primary cap-application station 1. The main parts of this station are a supply chute 4 in which the caps 5, suitably oriented, are supplied in the direction of the arrow B to the cap-applicator 6A, 6B which delivers a cap 5 and positions it with its front edge 5*a* in the path of movement of the top of the bottle 3, the cap being tilted and its sealing surface facing the bottle opening. The lower part 6B of the cap-applicator is pivoted at 8 and includes an upper shoulder 9 cooperating with a corresponding lower shoulder 10 on the upper part 6A. A spring 6C pivots part 6B in this inactive position with the shoulders 9 in contact with the shoulder 10. The bottle passing beneath the cap-applicator encounters the edge 5*a* of a cap, pulling the cap 5 with it so that it is released and placed in sealing position on the mouth of the bottle. A protective plate 11 is provided in order to prevent tall bottles from engaging and bending the pulling member 7 of the cap 5. The mobility of the lower portion 6B of the cap-applicator allows it to be raised out of the way without being damaged by bottles which are too tall.

Viewed in the direction of transport A of the bottles 3, a sensing means 12 is arranged downstream of the primary cap-applicator 1. The sensing means includes a photoelectric sensor 13 having two photocells to eliminate the risk of an incorrect signal if the bottle should vibrate while passing. The photocells emit a signal to a control unit when a bottle 3 passes. An inductive transducer 14 is also provided to sense when a cap 5 passes and emit a signal to the control unit.

Downstream of the sensing means is the secondary cap-applicator 2 of substantially the same construction as the primary cap-applicator 1. One difference is the provision of a blocking mechanism 15 preventing caps 5 from reaching the interception position. Corresponding elements in the two cap-applicators are given the same reference numerals.

The blocking mechanism 15 includes a solenoid 16 and a blocking element 18 activated by a compression spring 17. The blocking element 18 normally restrains the leading cap in a position of readiness for release to the application positions. When activated by the control unit, the solenoid 16 will remove the blocking element 18 from its blocking position against the action of the spring 17, so that the cap 5 is fed from its position of readiness to a position of interception.

The control unit receiving signals from the inductive transducer 14 and photocell 13 is connected to solenoid 16 and emits an output signal to this solenoid 16 which is dependent on the signal status in the sensing means 12. In other words, the contorl unit emits an activating signal when the phogocell 13 indicates passage of a bottle at the same time as the inductive transducer gives a zero signal, i.e., that the bottom 3 has no cap 5. To ensure rapid actuation of the solenoid 16 it is supplied initially for a few milliseconds with an input signal which is 2–2.5 times the rated voltage, the signal level then being reduced to about 0.5 times the rated voltage once the solenoid 16 has been energized.

During production, bottles pass at high speed through the cap-applicator, 20 to 30 bottles a second. If sopme disturbance occurs in the supply of caps in the primary cap-applicator 1, a great many bottles may have time to pass through without being provided with caps 5, before the normal supply of caps resumes in the primary cap-applicator 1. In the event of such a disturbance, the sensing means 12 will activate the secondary cap-applicator 2, and the bottles 3 missed by the primary cap-application 1 will be provided with caps 5. The degree of rejection of bottles without caps is thus considerably reduced.

To determine whether the disturbance in the supply of caps in the first station 1 is of a temporary or a more permanent nature, the control unit may be provided with a timing and counting function and may be arranged to emit an alarm signal in the case of permanent disturbance.

The return function of the blocking element 18 can be controlled in principal in two different ways. In one alternative the blocking element 18 is retained in its withdrawn inoperative position until a bottle 3 with a cap 5 applied is detected, whereas in another alternative the blocking element 18 is allowed to return immediately to its blocking position after a cap 5 has been released to the interception position. If the first alternative is chosen, the control unit must be provided with some means, e.g. a time control restoring means, which prevents the blocking element 18 remaining in withdrawn position if the last bottle in a row lacks a cap, causing the blocking element 18 to be retracted from its blocking position.

Obviously the construction described above is only by way of example and several modifications are feasible. The blocking element 18, for example, can be designed in numerous different ways, such as intervening from the side or below or acting on the pulling member 7 of the cap 5. The blocking element 18 can also be designed to allow the first cap through, while restraining the second, allowing it to advance into a position of readiness for release when the blocking element 18 returns.

Another version might be for the secondary cap-applicator to be vertically movable, with the foremost cap in interception position. The vertical movement of the secondary cap-applicator could, in turn, be controlled by the control unit.

Furthermore, the supply chutes of the cap-applicators may be connected to one and the same supply means, for example, a common hopper, which is then provided with two separate cap outlets, or each station 1, 2 may be provided with an individual hopper.

It is apparent that the sensing means may be designed differently. The choice of detector for the cap is dependent on the cap material. Instead of photocells, intercepting light beams, for example, reflective photocells, may be used to indicate the passage of a bottle, or inductive transducers may be used. Also, the number of transducers or photocells used is optional.

I claim:

1. A cap applying apparatus comprising a primary cap-applicator for applying caps on containers, a secondary cap-applicator downstream of the primary cap-applicator for applying caps on containers which have passed the primary cap-applicator without having been provided with caps, and sensing means located between the primary and secondary cap-applicators to detect containers without caps and render operative the secondary cap-applicator for applying a cap.

2. A cap applying apparatus as set forth in claim 1, wherein the secondary cap-applicator includes a blocking means which normally restrains a cap in a position of readiness immediately prior to the application position, but which at a signal indicating a capless container releases the restrained cap to the application position.

3. A cap applying apparatus as set forth in claim 2, wherein the blocking means remains in release condition until a return signal is given.

4. A cap applying apparatus as set forth in claim 3, wherein a return signal is given if the sensing means fails to detect the absence of a cap on the next container.

5. A cap applying apparatus as set forth in claim 2, including a chute feeding the caps in a row, one after the other, in the secondary cap-applicator and wherein an entire row of caps is released when the blocking means is in its release position.

6. A cap applying apparatus as set forth in claim 2, including a chute feeding the caps in a row, one after the other, in the secondary cap-applicator, and wherein only one cap is released by the actuation of the blocking means to its release position, subsequent caps in the row remaining blocked.

7. A cap applying apparatus as set forth in claim 2, including an actuator for the blocking means for imparting reciprocating motion to the blocking means between cap restraining and releasing positions.

8. A cap applying apparatus as set forth in claim 7, wherein the actuator includes a solenoid for moving the blocking means to one position and a spring for moving the blocking means to the other position.

9. A cap applying apparatus as set forth in claim 1, wherein each of the cap-applicators is provided with a protective depending plate to protect a pulling member on the cap.

10. A cap applying apparatus as set forth in claim 1, including a conveyor for transporting containers in a stream to the primary cap-applicator, the sensing means and the secondary cap-applicator, a feed channel associated with each of the cap applicators for guiding the caps by gravity to a release position, in which the cap is oriented in an oblique position to be intercepted by the upper end of the bottle, a blocking gate at the lower discharge end of the supply channel for the secondary cap-applicator, said sensing means including cap detecting means, and means for releasing the blocking gate of the secondary cap-applicator when the sensing means detects a container without a cap.

11. A cap applying apparatus as set forth in claim 10, including means for yieldably supporting the discharge ends of the primary and secondary cap applicators to permit them to move out of the path of a tall container and a depending protective plate carried by the yieldable discharge ends of the cap applicators to engage the upper ends of tall bottles to prevent them from engagigng any portion of the cap prior to the engagement with the cap in the intercept position.

* * * * *

UNITED STATES PATENT AND TRADEMARK OFFICE

CERTIFICATE OF CORRECTION

PATENT NO. : 4,773,204

DATED : September 27, 1988

INVENTOR(S) : Gunnar Rydstrom

It is certified that error appears in the above-identified patent and that said Letters Patent is hereby corrected as shown below:

Col. 1, line 23, "plane" should read --plant--; Col. 2, line 23, "positions" should read --position--; Col. 2, line 33, "phogocell" should read --photocell--; Col. 2, line 43, "sopme" should read --some--; Col. 2, line 60, "principal" should read --principle--; and Col. 4, bridging lines 49-50, "engagigng" should read --engaging--.

Signed and Sealed this

Sixth Day of June, 1989

*Attest:*

*Attesting Officer*

DONALD J. QUIGG

*Commissioner of Patents and Trademarks*